US009704432B2

(12) United States Patent
Zhang et al.

(10) Patent No.: US 9,704,432 B2
(45) Date of Patent: Jul. 11, 2017

(54) LUMINANCE COMPENSATION METHOD AND LUMINANCE COMPENSATION DEVICE OF DISPLAY DEVICE, AND DISPLAY DEVICE

(71) Applicant: BOE TECHNOLOGY GROUP CO., LTD., Beijing (CN)

(72) Inventors: Xiangfei Zhang, Beijing (CN); Zhongyuan Wu, Beijing (CN); Yang Zhou, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 93 days.

(21) Appl. No.: 14/646,086

(22) PCT Filed: Oct. 14, 2014

(86) PCT No.: PCT/CN2014/088587

§ 371 (c)(1),
(2) Date: May 20, 2015

(87) PCT Pub. No.: WO2015/180371

PCT Pub. Date: Dec. 3, 2015

(65) Prior Publication Data

US 2016/0267838 A1 Sep. 15, 2016

(30) Foreign Application Priority Data

May 30, 2014 (CN) ..... 2014 1 0240526

(51) Int. Cl.
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2320/0233* (2013.01);
(Continued)

(58) Field of Classification Search
CPC ..... G09G 2360/16; G09G 2320/0276; G09G 3/22
See application file for complete search history.

(56) References Cited

U.S. PATENT DOCUMENTS

2002/0149806 A1 10/2002 Westerman
2004/0109091 A1 6/2004 Park et al.
(Continued)

FOREIGN PATENT DOCUMENTS

CN 1373612 A 10/2002
CN 1535000 A 10/2004
(Continued)

OTHER PUBLICATIONS

International Search Report Appln. No. PCT/CN2014/088587; Dated Feb. 15, 2015.
(Continued)

*Primary Examiner* — Gerald Johnson
(74) *Attorney, Agent, or Firm* — Ladas & Parry LLP

(57) ABSTRACT

A luminance compensation method and a luminance compensation device of a display device, and the display device are provided. The luminance compensation method of the display device, includes: obtaining an input grayscale value of one of a plurality of sub-pixels corresponding to the display device of an input image, and obtaining a functional relationship between a compensated grayscale value and the input grayscale value corresponding to the sub-pixel; obtaining the compensated grayscale value corresponding to the sub-pixel by using the functional relationship, and performing luminance compensation on the sub-pixel according to the compensated grayscale value; and executing the above operations repeatedly for each of the plurality of sub-pixels of the input image.

18 Claims, 4 Drawing Sheets

(52) U.S. Cl.
CPC ..... *G09G 2320/045* (2013.01); *G09G 2320/0666* (2013.01); *G09G 2320/0693* (2013.01); *G09G 2360/14* (2013.01); *G09G 2360/141* (2013.01); *G09G 2360/145* (2013.01)

(56) References Cited

U.S. PATENT DOCUMENTS

| | | | | |
|---|---|---|---|---|
| 2005/0200293 | A1 | 9/2005 | Naugler, Jr. et al. | |
| 2007/0273776 | A1 | 11/2007 | Lee | |
| 2008/0180375 | A1 | 7/2008 | Wang | |
| 2009/0284450 | A1 | 11/2009 | Ishige et al. | |
| 2013/0147693 | A1 | 6/2013 | Bae | |
| 2014/0028732 | A1 | 1/2014 | Kim et al. | |
| 2014/0063080 | A1 | 3/2014 | Wu et al. | |
| 2014/0285533 | A1* | 9/2014 | Chun ..... | G09G 3/3208 345/690 |

FOREIGN PATENT DOCUMENTS

| | | | |
|---|---|---|---|
| CN | 1655015 | A | 8/2005 |
| CN | 101083773 | A | 12/2007 |
| CN | 101231830 | A | 7/2008 |
| CN | 101123074 | A | 12/2008 |
| CN | 101568956 | A | 10/2009 |
| CN | 101582240 | A | 11/2009 |
| CN | 102855842 | A | 1/2013 |
| CN | 103165076 | A | 6/2013 |
| CN | 104021759 | A | 9/2014 |
| WO | 2009086742 | A1 | 7/2009 |

OTHER PUBLICATIONS

Written Opinion of the International Searching Authority Appln. No. Feb. 15, 2015.

Third Chinese Office Action dated Jul. 26, 2016; Appln. No. 201410240526.7.

First Chinese Office Action Appln. No. 201410240526.7; Dated Sep. 2, 2015.

Second Chinese Office Action Appln. No. 20141024056.7; Dated Mar. 15, 2016.

* cited by examiner

LUMINANCE COMPENSATION METHOD AND LUMINANCE COMPENSATION DEVICE OF DISPLAY DEVICE, AND DISPLAY DEVICE

TECHNICAL FIELD

Embodiments of the invention relate to a luminance compensation method and a luminance compensation device of a display device, and a display device.

BACKGROUND

Under present technical conditions, an Organic Light Emitting Diode (OLED) display device has spatial and temporal non-uniformity, and as a size of the display device increases, such problems become more and more apparent, so how to solve the non-uniformity of display of the large-sized OLED display device becomes one of key technologies. The non-uniformity of display of the OLED display device is closely related with the manufacturing process; when threshold voltages of pixels of an entire display panel are quite different, overall luminance uniformity of the display device will be deteriorated. Moreover, organic material is accompanied with the problem of luminance changing in its service life. Hence, various compensation methods are needed to improve the non-uniformity of display.

The compensation method may be divided into two categories: internal compensation and external compensation. The internal compensation refers to a method for compensating using a sub-circuit constructed by a Thin Film Transistor (TFT) inside a pixel; the external compensation refers to a compensating method in which a TFT or OLED signal is extracted out of the display panel, and then by using an outside Application Specific Integrated Circuit (ASIC) outside, the compensating is performed. Generally, both the pixel structure and driving mode of the internal compensation are relatively complex; and in display applications of large size, high resolution and high refresh rate, the internal compensation method may cause a decreased aperture ratio and a slow driving speed; while the external compensation has a simple pixel structure, a faster driving speed and a better compensation effect.

The external compensation may be further divided into an optical extraction mode and an electrical extraction mode depending on different data extraction methods. The optical extraction mode refers to extracting a luminance signal by an image sensor, for example, photographing of a Charge Coupled Device (CCD), after the display panel is lightened; and the electrical extraction mode refers to extracting an electrical signal of the TFT and the OLED by a sensing circuit of a driving chip. Since the signals extracted by the two methods are different in type, data processing methods are also different. However, a highly efficient luminance compensation method is needed at present.

SUMMARY OF THE INVENTION

Embodiments of the present invention provide a luminance compensation method and a luminance compensation device of a display device, and the display device, which can improve luminance information extraction efficiency for the display device, in a process of improving luminance uniformity of the display device.

In one aspect, an embodiment of the present invention provides a luminance compensation method of a display device, comprising: obtaining an input grayscale value of one of a plurality of sub-pixels corresponding to the display device of an input image, and obtaining a functional relationship between a compensated grayscale value and the input grayscale value corresponding to the sub-pixel; obtaining the compensated grayscale value corresponding to the sub-pixel by using the functional relationship, and performing luminance compensation on the sub-pixel according to the compensated grayscale value; and executing the above operations repeatedly for each of the plurality of sub-pixels of the input image.

In another aspect, an embodiment of the present invention provides a luminance compensation device of a display device, comprising: an obtaining unit, configured to obtain an input grayscale value of a current sub-pixel, and obtain a functional relationship between a compensated grayscale value and the input grayscale value corresponding to the sub-pixel, for each of sub-pixels corresponding to the display device in an input image; a compensating unit, configured to obtain the compensated grayscale value corresponding to the sub-pixel by using the input grayscale value of the sub-pixel and the functional relationship, and perform luminance compensation on the sub-pixel according to the compensated grayscale value, for each of the sub-pixels corresponding to the display device in the input image.

In still another aspect, an embodiment of the present invention provides a display device, comprising the above-described luminance compensation device.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DESCRIPTION OF THE EMBODIMENTS

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Embodiments of the present invention provide a luminance compensation method and a luminance compensation device of a display device, and a display device, for improving luminance information extraction efficiency for the display device during improving luminance uniformity of the display device.

Figure 1:
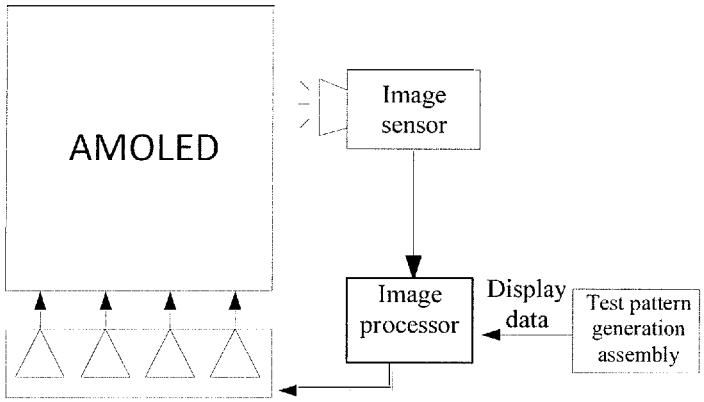
FIG. 1 is a principle diagram of an exemplary external optical compensation solution.
Figure 2:
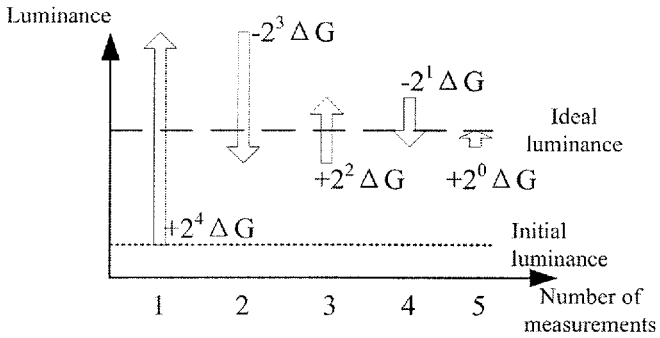
FIG. 2 is a schematic diagram of a calculation method of the exemplary external optical compensation.

FIG. 1 is a schematic diagram of a principle of an exemplary external optical compensation solution, and an image sensor is typically a CCD camera. The method is to compare a luminance value acquired by photographing with an ideal value, and then select an appropriate grayscale offset ΔG, to proceed in a successive approximation manner, as shown in FIG. 2. A compensation accuracy of this method depends on a magnitude of ΔG, and a compensation range is $(2^n-1)\Delta G$, where n is the number of measurements. Thus, in order to improve the accuracy, ΔG needs to be reduced, and in order to expand the compensation range, the number of measurements has to be increased; however, for each grayscale, the measurement and the comparison need to be performed many times, so that efficiency is very low. Therefore, how to achieve highly-efficient external optical compensation in mass production becomes one of the technical problems of productization of the large-sized AMOLED.

Hereinafter, the technical solution of an embodiment of the present invention will be described in a clearly and fully understandable way. It is obvious that the described embodiments are just a part but not all of the embodiments of the invention. Based on the described embodiments herein, those skilled in the art can obtain other embodiment(s), without any inventive work, which should be within the scope of the embodiments of the present invention.

Figure 3:
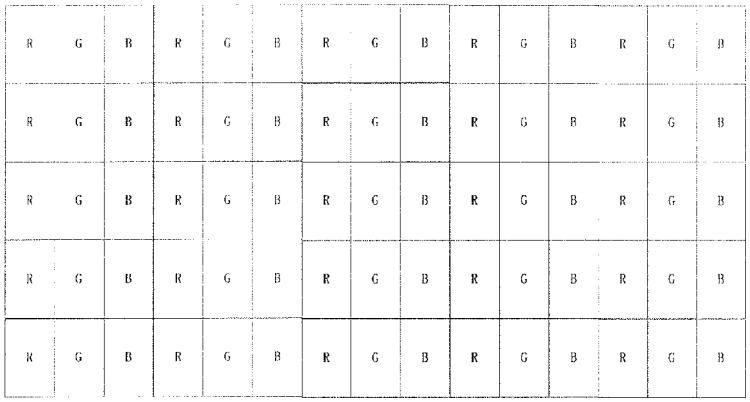
FIG. 3 is a schematic diagram of an arrangement mode of sub-pixels of a display device.

Generally, a display device includes m rows and n columns of pixels, and then the display device includes m×n pixels; it is assumed that each pixel includes three sub-pixels: a red pixel R, a green pixel G and a blue pixel B, then the display device includes m×n×3 sub-pixels. For example, as shown in FIG. 3, for a display device of 5 rows and 5 columns, the display device includes 5×15 sub-pixels. When the luminance compensation is performed for an input image of the display device, the luminance compensation is performed for the display device in a unit of each sub-pixel.

An embodiment of the present invention provides a luminance compensation method of a display device, comprising:

Obtaining an input grayscale value of one of a plurality of sub-pixels corresponding to the display device of an input image, and obtaining a functional relationship between a compensated grayscale value corresponding to the sub-pixel and the input grayscale value;

Obtaining the compensated grayscale value corresponding to the sub-pixel by using the functional relationship, and performing luminance compensation on the sub-pixel according to the compensated grayscale value; and then executing the above operations repeatedly for each of the plurality of sub-pixels of the input image.

Furthermore, the functional relationship is determined for each sub-pixel of the display device, according to a test luminance value and a target luminance value of the each sub-pixel under a plurality of test patterns of different test grayscale values.

In the above-described luminance compensation method provided by the embodiment of the present invention, the functional relationship between the compensated grayscale value and the test grayscale value corresponding to the sub-pixel in advance is determined, according to the test luminance value and the target luminance value of each sub-pixel under the plurality of test patterns, that is, the functional relationship between the compensated grayscale value and the input grayscale value corresponding to the sub-pixel is determined. When the display device normally displays, the functional relationship corresponding to each sub-pixel is obtained, and for each sub-pixel in the input image, luminance compensation is performed on the sub-pixel by using the functional relationship corresponding to the sub-pixel, so it is not necessary to perform many times of measurements for each test pattern, thereby improving luminance information extraction efficiency for the display device, in a process of improving luminance uniformity of the display device.

Exemplarily, the determining the functional relationship according to the test luminance value and the target luminance value of the sub-pixel under the plurality of test patterns of different grayscale values in advance, for each sub-pixel, includes:

For each sub-pixel,

Determining a functional relationship between the test luminance value and the test grayscale value of the sub-pixel, according to a plurality of test grayscale values and a plurality of test luminance values under the plurality of test grayscale values;

Determining a functional relationship between the target luminance value and the test grayscale value of the sub-pixel, according to the plurality of test grayscale values and target luminance values under the plurality of test grayscale values;

Determining a grayscale compensation amount corresponding to each test grayscale value of the sub-pixel, according to the functional relationship between the test luminance value and the test grayscale value and the functional relationship between the target luminance value and the test grayscale value;

Determining a functional relationship between the compensated grayscale value and the test grayscale value corresponding to the sub-pixel, according to the grayscale compensation amount corresponding to each test grayscale value of the sub-pixel, that is, the functional relationship between the compensated grayscale value and the input grayscale value corresponding to the sub-pixel.

In the embodiment of the present invention, for the determining the functional relationship between the test luminance value and the test grayscale value of the sub-pixel, according to a plurality of test grayscale values and the test luminance values under the plurality of test grayscale values; the determining the functional relationship between the target luminance value and the test grayscale value of the sub-pixel, according to a plurality of test grayscale values and target luminance values under the plurality of test grayscale values; the determining a grayscale compensation amount corresponding to each test grayscale value of the sub-pixel, according to the functional relationship between the test luminance value and the test grayscale value and the functional relationship between the target luminance value and the test grayscale value; and the determining a functional relationship between the compensated grayscale value and the test grayscale value corresponding to the sub-pixel, according to the grayscale compensation amount corresponding to each test grayscale value of the sub-pixel; when the functional relationships are determined, for example, a polynomial fitting method and a gamma function fitting method may be used.

Exemplarily, before the determining the functional relationship according to the test luminance value and the target luminance value of the sub-pixel under the plurality of test patterns of different grayscale values, for each sub-pixel, the method further comprises:

Selecting a part of the grayscale values from among all the grayscale values of the display device as the plurality of test grayscale values;

Determining different test patterns according to the selected test grayscale values;

Collecting the test luminance value under different test patterns by using an image sensor.

For example, a display device supporting 256 grayscale display is taken as an example, in an actual test, for different test requirements, a part of grayscale values among the 256 grayscale values are selected as test grayscale values according to a response relationship between luminance and grayscale of the display device and performance parameters of the image sensor, for example, 6 grayscale values may be selected as the test grayscale values, and thus, the information extraction efficiency can be further improved due to reduction of information collected. Of course, the test pattern corresponding to each grayscale value of the 256 grayscale values may be tested. When the test luminance value under the test grayscale value is collected by the image sensor, the image sensor may be, for example, a CCD.

Exemplarily, the obtaining a functional relationship corresponding to a current sub-pixel, includes:

Obtaining the functional relationship corresponding to the current sub-pixel from a volatile memory.

Since data is read from the volatile memory faster, when the display device displays pictures in real time, luminance compensation can be performed on each sub-pixel of the input image on the display panel quickly.

Exemplarily, the obtaining a functional relationship corresponding to the current sub-pixel, further includes:

Reading the functional relationship corresponding to the current sub-pixel from a non-volatile memory to the volatile memory, before obtaining the functional relationship corresponding to the current sub-pixel from the volatile memory.

Since a data is only retained in the volatile memory for a short time, by storing the functional relationship between the compensated grayscale value corresponding to the sub-pixel and the input grayscale value which is set for each sub-pixel of the display device in advance in the non-volatile memory, life of the stored data can be ensured; and at the same time, when the display device works normally, the functional relationship is read from the non-volatile memory to the volatile memory, and the functional relationship is obtained from the volatile memory in real time, so as to ensure efficiency of real-time compensation.

Exemplarily, the functional relationship between the compensated grayscale value and the input grayscale value corresponding to any sub-pixel complies with a formula below:

$$G_{ij,x}'=C_{ij,n}G_x^{\,n}+C_{ij,n-1}G_x^{\,n-1}+\ldots+C_{ij,1}G_x+C_{ij,0},$$

Where, $G_{ij,x}'$ is a compensated grayscale value corresponding to a sub-pixel in i-th row and j-th column, $G_x$ is an input grayscale value corresponding to the sub-pixel, $C_{ij,n}$ is a coefficient of an n-th expansion item of $G_x$, n is a natural number, and i, j are positive integers.

It should be noted that, the above formula is only one example of the functional relationship between the compensated grayscale value and the input grayscale value corresponding to any sub-pixel, and the functional relationship is not limited to the above formula. For example, the functional relationship may also be a gamma functional relationship.

The luminance compensation method of the display device provided by the embodiment of the present invention will be described hereinafter in conjunction with the accompanying drawings.

In the luminance compensation method of the display device provided by the embodiment of the present invention, it is necessary to in advance determine the functional relationship between the compensated grayscale value and the input grayscale value corresponding to the sub-pixel, for each sub-pixel of the display device. Exemplarily, the process of determining the functional relationship between the compensated grayscale value and the input grayscale value corresponding to the sub-pixel for each sub-pixel of the display device, is completed before the display device leaves the factory. Hereinafter, the process of determining the functional relationship between the compensated grayscale value and the input grayscale value corresponding to the sub-pixel, for each sub-pixel of the display device in advance will be exemplarily described.

Hereinafter, the display device supporting 256 grayscales is taken as an example for description. Of course, it is not limited to the display device supporting 256 grayscales, for example, it may be a display device supporting 1024 grayscales. Here, the display device supporting 256 grayscales is taken as an example for description, merely in order to better describe the embodiment of the present invention.

Exemplarily, the determining the functional relationship between the compensated grayscale value and the input grayscale value corresponding to the sub-pixel, for each sub-pixel of the display device in advance, includes:

Step S401: determining different test patterns according to the selected test grayscale values;

Step S402: obtaining test luminance values under the different test patterns collected by an image sensor, Step S403: determining a functional relationship between the test luminance value and the test grayscale value of the sub-pixel, according to a plurality of test grayscale values and test luminance values under the plurality of test grayscale values;

Step S404: determining a functional relationship between the target luminance value and the test grayscale value of the sub-pixel, according to a plurality of test grayscale values and target luminance values under the plurality of test grayscale values;

Step S405: determining a grayscale compensation amount corresponding to each test grayscale value of the sub-pixel, according to the functional relationship between the test luminance value and the test grayscale value and the functional relationship between the target luminance value and the test grayscale value;

Step S406: determining a functional relationship between the compensated grayscale value and the test grayscale value corresponding to the sub-pixel, according to the grayscale compensation amount corresponding to each test grayscale value of the sub-pixel, that is, the functional relationship between the compensated grayscale value and the input grayscale value corresponding to the sub-pixel.

In step S401, a part of grayscale values among the 256 grayscale values of the display device are selected as the test grayscale values, according to the response relationship between the luminance and the grayscale of the display device and the performance parameters of the image sensor, for example, the test grayscale values include $G_1$, $G_2$, $G_3$ . . . $G_K$. After the test grayscale values are determined, different test patterns are determined according to these grayscale values, and display of the display panel of the display device is controlled according to the test patterns determined. Technologies known to the inventor are used for both determining the test patterns according to the test grayscale values and controlling display of the display panel of the display device according to the test patterns, which will not be repeated here.

In step S402, the test luminance value under the test pattern collected by the image sensor is obtained, for example, the test luminance value of each sub-pixel under the test grayscale value collected by the CCD is obtained.

For the display device including i×j sub-pixels, for each sub-pixel, an array of test luminance values may be obtained under the different test grayscale values, for example, for the sub-pixel in a first row and a first column, an array with K items may be obtained: ($L_{11,1}$, $L_{11,2}$ . . . $L_{11,k}$), an array corresponding to the sub-pixel in i-th row and j-th column is: ($L_{ij,1}$, $L_{ij,2}$ . . . $L_{ij,k}$), where $L_{11,k}$ is a test luminance value of the sub-pixel in the first row and the first column when the test grayscale value is $G_k$, and $L_{ij,k}$ is a test luminance value of the sub-pixel in the i-th row and the j-th column when the test grayscale value is $G_k$. Therefore, for the display device, i×j arrays can be obtained.

Moreover, in order to perform luminance compensation for each sub-pixel, it is also necessary to determine a group of target luminance values corresponding to K test grayscale values. When the target luminance value is determined, two modes may be used: one is to preset the target luminance value under the test grayscale value, and the other is to average all of the test luminance values for each test grayscale value. When all of the test luminance values are averaged to obtain the target luminance value, for example, a formula below may be used:

$$L_K = \frac{\sum L_{ij,k}}{i * j};$$

Where, $L_k$ is a target luminance value when the test grayscale value is $G_K$, and under the test grayscale value of $G_K$, the test luminance values of all of the sub-pixels (i×j sub-pixels) of the display device are averaged, to obtain the target luminance value $L_K$ under the test grayscale value.

In step S403, the functional relationship between the test luminance value and the test grayscale value of the sub-pixel is determined, according to the plurality of test grayscale values and the test luminance values under the plurality of test grayscale values. For example, for each sub-pixel, polynomial fitting may be performed on the arrays of the test luminance values under the plurality of test grayscale values and the plurality of test grayscale values corresponding to the sub-pixel, by using a least square method, so as to obtain the functional relationship between the test luminance value and the test grayscale value of the sub-pixel, for example, it may be a polynomial below:

$$L_{ij,x}=A_{ij,n}G_x^{\,n}+A_{ij,n-1}G_x^{\,n-1}+\ldots+A_{ij,1}G_x+A_{ij,0};$$

Where, $L_{ij,x}$ is a test luminance value corresponding to the test grayscale value $G_x$ of the sub-pixel in i-th row and j-th column, and in a case where 256 grayscales are supported, $G_x$ is a value selected from [0,255]; $A_{ij,n}$ is a coefficient of the n-th expansion item of $G_x$, and n is a natural number. That is to say, in the embodiment of the present invention, it is not necessary to test all of the grayscale values supported by the display device, but it is only necessary to select a part of grayscale values as the test grayscale values so as to obtain the test luminance values. For each sub-pixel, a plurality of arrays of test luminance values and a plurality of test grayscale values are fitted, to obtain the functional relationship between the test luminance value and the test grayscale value. Of course, no matter which type of fitting method is used, it may be done as long as a test luminance value obtained by the functional relationship between the test luminance value and the test grayscale value can be approximate to an actually tested luminance value for each test grayscale value to a maximum extent. Thus, an enormous amount of test time can be saved to improve the overall efficiency of luminance compensation.

In step S404, the functional relationship between the target luminance value and the test grayscale value of the sub-pixel is determined, according to a plurality of test grayscale values and target luminance values under the plurality of test grayscale values. For example, the polynomial fitting may be performed on the arrays of the target luminance values under the plurality of test grayscale values and the plurality of test grayscale values, by using the least square method, according to the target luminance values of the plurality of test grayscale values determined previously, so as to obtain the functional relationship between the target luminance value and the test grayscale value, for example, it may be a polynomial below:

$$L_{t,x}=B_{t,n}G_x^{\,n}+B_{t,n-1}G_x^{\,n-1}+\ldots+B_{t,1}G_x+B_{t,0};$$

Where, $L_{t,x}$ is a target luminance value corresponding to an input grayscale value $G_x$, and in a case where 256 grayscales are supported, $G_x$ is a value selected from [0,255]; $B_{t,n}$ is a coefficient of the n-th expansion item of $G_x$, and n is a natural number.

In step S405, the grayscale compensation amount corresponding to each test grayscale value of the sub-pixel is determined, according to the functional relationship between the test luminance value and the test grayscale value and the functional relationship between the target luminance value and the test grayscale value.

When the functional relationship between the test luminance value and the test grayscale value complies with a formula below:

$$L_{ij,x}=A_{ij,n}G_x^{\,n}+A_{ij,n-1}G_x^{\,n-1}+\ldots+A_{ij,1}G_x+A_{ij,0},$$

and, when the functional relationship between the target luminance value and the input grayscale value complies with a formula below:

$$L_{t,x}=B_{t,n}G_x^{\,n}+B_{t,n-1}G_x^{\,n-1}+\ldots+B_{t,1}G_x+B_{t,0},$$

the step is explained and described with a case where the functional relationship between the test luminance value and the test grayscale value and the functional relationship between the target luminance value and the test grayscale value respectively comply with the above formulae as an example.

Figure 4:
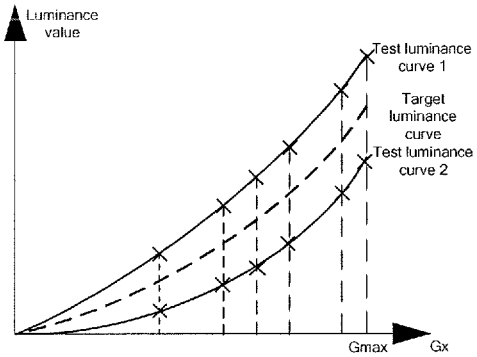
FIG. 4 is a schematic diagram of a test luminance curve and a target luminance curve according to an embodiment of the present invention.
Figure 5:
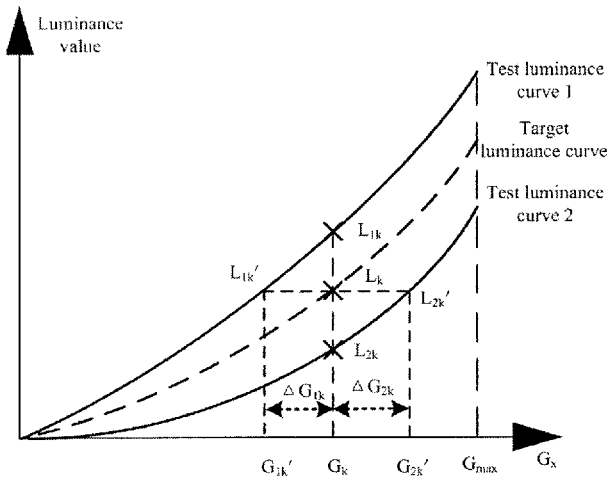
FIG. 5 is a schematic diagram of determining a grayscale compensation amount that enables a test luminance value to reach a target luminance value according to an embodiment of the present invention.

When the functional relationship between the test luminance value and the test grayscale value and the functional relationship between the target luminance value and the test grayscale value comply with the above formulae, respectively, a curve comparison chart of the test luminance value VS the test grayscale value and the target luminance value VS the test grayscale value as shown in FIG. 4 can be obtained, in which a test luminance curve 1 and a test luminance curve 2 are respectively curves of the test luminance value and the test grayscale value of a first sub-pixel and a second sub-pixel arbitrarily selected for illustration. Under a same test grayscale value, in order to achieve identical luminance of all of the sub-pixels, it is necessary to respectively adjust the grayscale values of the two sub-pixels with the target luminance value as a reference; as shown in FIG. 5, $G_k$ is the selected grayscale value, the test luminance value of the first sub-pixel under the test grayscale value is $L_{1k}$, the test luminance value of the second sub-pixel under the test grayscale value is $L_{2k}$; $G_{1k}'$ is a new grayscale value when the first sub-pixel reaches the target luminance value $L_k$; $G_{2k}'$ is a new grayscale value when the second sub-pixel reaches the target luminance value $L_k$, $\Delta G_{1k}$ is a grayscale compensation amount when the first sub-pixel reaches the target luminance value $L_k$, and $\Delta G_{2k}$ is a grayscale compensation amount when the second sub-pixel reaches the target luminance value $L_k$; Gmax represents a maximum grayscale value of the display device; $L_{1k}'$ represents the test luminance value corresponding to $G_{1k}'$ on the test luminance curve 1, $L_{2k}'$ represents the test luminance value corresponding to $G_{2k}'$ on the test luminance curve 2, and $L_{1k}'$ and $L_{2k}'$ are equal to $L_{1k}$. According to the above-described method, the grayscale compensation amount of each of the input grayscale values of each sub-pixel can be obtained.

In step S406, the functional relationship between the compensated grayscale value and the test grayscale value corresponding to the sub-pixel is determined, according to the grayscale compensation amount corresponding to each test grayscale value of the sub-pixel. Exemplarily, the polynomial fitting is performed for a plurality of grayscale compensation amounts of each sub-pixel, according to the obtained grayscale compensation amount of each of the test grayscale values of each sub-pixel, to obtain a polynomial of a compensated grayscale value $G_{ij,x}'$ and an input grayscale value $G_{ij,x}$, for example, the polynomial complies with a formula below:

$$G_{ij,x}'=C_{ij,n}G_x^n+C_{ij,n-1}G_x^{n-1}+\ldots+C_{ij,1}G_x+C_{ij,0};$$

Figure 6:
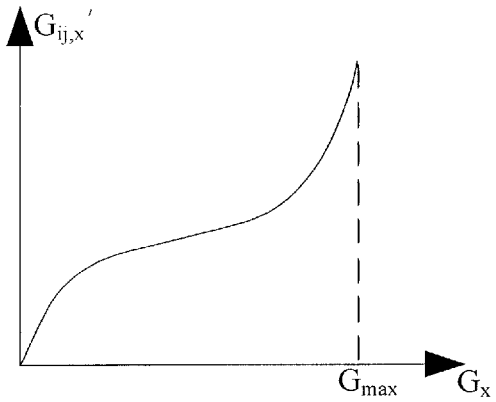
FIG. 6 is a schematic diagram of a relationship curve between a compensated grayscale value and an input grayscale value according to an embodiment of the present invention.

Where, $G_{ij,x}'$ is a compensated grayscale value corresponding to the sub-pixel in i-th row and j-th column, $G_x$ is an input grayscale value corresponding to the sub-pixel, $C_{ij,n}$ is a coefficient of an n-th expansion item of $G_x$, n is a natural number, and i, j are positive integers. More intuitively, a relationship curve chart between the compensated grayscale value $G_{ij,x}'$ and the input grayscale value $G_x$ as shown in FIG. 6 may be obtained according to the formula; and from the relationship curve chart as shown in FIG. 6, the corresponding relationship between the compensated grayscale value and the input grayscale value may be understood more intuitively.

It should be noted that, when the polynomial of the compensated grayscale value $G_{ij,x}'$ and the input grayscale value $G_{ij,x}$ is used as the functional relationship between the compensated grayscale value and the input grayscale value corresponding to the sub-pixel, with a data size of each coefficient in the polynomial being 8 bits as an example, for the display device including i×j sub-pixels, the size of the data consisting of these coefficients is i×j×(n+1)×8 bits; and with the display device including 3840*2160 pixels as an example, the data size of the coefficients is 3840*2160*3*(n+1)*8 bits, so a magnitude of n determines complexity of the algorithm; under a condition that a compensation effect is ensured, to select a smaller value of n can save more resource, so n is generally no greater than 3, that is to say, the highest power of $G_x$ is 3, so that a sum of the data sizes are less than 1 G bits.

After the functional relationship between the compensated grayscale value and the input grayscale value corresponding to the sub-pixel is preset for each sub-pixel of the display device, the functional relationship is stored in a memory of the display device. Exemplarily, since the non-volatile memory can store data for a longer time, while the volatile memory reads the data fast, when the functional relationship is to be stored in the memory of the display device, the functional relationship is actually stored in the non-volatile memory of the display device.

When the display device works normally, the functional relationship between the compensated grayscale value and the input grayscale value corresponding to each sub-pixel is read from the non-volatile memory to the volatile memory, and the functional relationship between the compensated grayscale value and the input grayscale value corresponding to each sub-pixel is obtained from the volatile memory in real time, so that luminance compensation can be performed in real time, and finally the luminance uniformity of the display device is improved. Exemplarily, when the display device works normally, the luminance compensation method of the display device is as follows:

Steps below are executed specifically, for each sub-pixel corresponding to the display device in the input image:

Step S801: obtaining an input grayscale value of a current sub-pixel and a functional relationship corresponding to the current sub-pixel; the functional relationship being in advance determined according to a test luminance value and a target luminance value of the sub-pixel under a plurality of test patterns of different grayscale values, for each sub-pixel of the display device, and the functional relationship being a corresponding relationship between the compensated grayscale value and the input grayscale value corresponding to the sub-pixel;

Step S802: obtaining the compensated grayscale value corresponding to the sub-pixel by using the input grayscale value of the sub-pixel and the corresponding functional relationship, and performing luminance compensation on the sub-pixel according to the compensated grayscale value.

In the above-described luminance compensation method provided by the embodiment of the present invention, the functional relationship between the compensated grayscale value and the input grayscale value corresponding to each sub-pixel is set in advance, according to the test luminance value and the target luminance value of the sub-pixel under the plurality of test patterns; when the display device normally displays, the functional relationship corresponding to each sub-pixel is obtained, and luminance compensation is performed on the sub-pixel by using the functional relationship corresponding to the sub-pixel, for the input grayscale value of each sub-pixel in the input image, so it is not necessary to perform many times of measurements for each test pattern, thus improving the luminance information extraction efficiency for the display device, in the process of improving the luminance uniformity of the display device. Further, by storing the functional relationship between the compensated grayscale value and the input grayscale value corresponding to each sub-pixel of the display device preset for the sub-pixel in the non-volatile memory, life of the stored data can be ensured; and at the same time, when the display device works normally, the functional relationship is read from the non-volatile memory to the volatile memory, and the functional relationship is obtained from the volatile memory in real time, so as to ensure the efficiency of the real-time compensation.

The luminance compensation method of the display device provided by the embodiment of the present invention is described in detail hereinbefore, and a luminance compensation device of a display device provided by an embodiment of the present invention will be described hereinafter in conjunction with the accompanying drawings.

Figure 7:
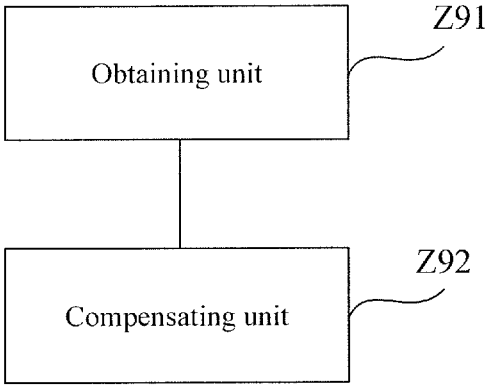
FIG. 7 is a structural schematic diagram of a luminance compensation device of a display device provided by an embodiment of the present invention.

As shown in FIG. 7, the luminance compensation device of the display device provided by the embodiment of the present invention, comprises:

An obtaining unit Z91, configured to obtain an input grayscale value of a current sub-pixel and a functional relationship corresponding to the current sub-pixel, for each sub-pixel corresponding to the display device in an input image, and the functional relationship being determined according to a test luminance value and a target luminance value of the sub-pixel under a plurality of test patterns of different grayscale values in advance, for each sub-pixel of the display device, and the functional relationship being a corresponding relationship between a compensated grayscale value and the input grayscale value corresponding to the sub-pixel;

A compensating unit Z92, configured to obtain the compensated grayscale value corresponding to the sub-pixel by using the input grayscale value of the sub-pixel and the corresponding functional relationship, and perform luminance compensation on the sub-pixel according to the compensated grayscale value, for each sub-pixel corresponding to the display device in the input image.

Exemplarily, the above-described luminance compensation device provided by the embodiment of the present invention may be a control module of the display device. Therein, the obtaining unit and the compensating unit may be implemented by, for example, a processor.

The above-described luminance compensation device provided by the embodiment of the present invention, sets the functional relationship between the compensated grayscale value and the input grayscale value in advance corresponding to each sub-pixel, according to the test luminance value and the target luminance value of the sub-pixel under the plurality of test patterns, and when the display device normally displays, obtains the functional relationship corresponding to each sub-pixel, and performs luminance compensation on the sub-pixel by using the functional relationship corresponding to the sub-pixel, for each sub-pixel in the input image, so it is not necessary to perform many times of measurements for each test pattern, thus improving the luminance information extraction efficiency for the display device, in the process of improving the luminance uniformity of the display device.

Exemplarily, the luminance compensation device may further comprise:

A presetting unit, configured to: for each sub-pixel, determine a functional relationship between the test luminance value and the test grayscale value of the sub-pixel, according to a plurality of test grayscale values and test luminance values under the plurality of test grayscale values;

determine a functional relationship between the target luminance value and the test grayscale value of the sub-pixel, according to the plurality of test grayscale values and target luminance values under the plurality of test grayscale values;

determine a grayscale compensation amount corresponding to each of the test grayscale values of the sub-pixel, according to the functional relationship between the test luminance value and the input grayscale value and the functional relationship between the target luminance value and the test grayscale value;

determine a functional relationship between the compensated grayscale value and the test grayscale value corresponding to the sub-pixel, according to the grayscale compensation amount corresponding to each of the test grayscale values of the sub-pixel, that is, the functional relationship between the compensated grayscale value and the input grayscale value corresponding to the sub-pixel.

It should be noted that, the presetting unit may either be disposed inside the display device, or be independent of the display device. Exemplarily, the presetting unit is a data processor independent of the display device.

In the embodiment of the present invention, for the determining a functional relationship between the test luminance value and the test grayscale value of the sub-pixel, according to a plurality of test grayscale values and the test luminance values under the plurality of test grayscale values; the determining a functional relationship between the target luminance value and the test grayscale value of the sub-pixel, according to a plurality of test grayscale values and target luminance values under the plurality of test grayscale values; the determining a grayscale compensation amount corresponding to each of the test grayscale values of the sub-pixel, according to the functional relationship between the test luminance value and the input grayscale value and the functional relationship between the target luminance value and the test grayscale value; and the determining a functional relationship between the compensated grayscale value and the test grayscale value corresponding to the sub-pixel, according to the grayscale compensation amount corresponding to each to the test grayscale values of the sub-pixel; when the functional relationships are determined, for example, a polynomial fitting method and a gamma function fitting method may be used.

Exemplarily, the presetting unit may further be configured to:

Obtain test luminance values under different test patterns collected by using an image sensor, after selecting a part of the grayscale values from among all grayscale values of the display device as the test grayscale values, and determining test patterns according to the selected test grayscale values.

For example, a display device supporting 256 grayscale display is taken as an example, in an actual test, for different testing requirements, a part of grayscale values among the 256 grayscale values are selected as test grayscale values according to a response relationship between luminance and grayscale of the display device and performance parameters of the image sensor, for example, 6 grayscale values may be selected as the test grayscale values, and thus, the information extraction efficiency can be further improved. Of course, the pattern corresponding to each of the 256 grayscale values may be tested.

Exemplarily, the obtaining unit is configured to: obtain the functional relationship corresponding to the current sub-pixel from a volatile memory.

Since data is read from the volatile memory faster, when the display device displays pictures in real time, luminance compensation can be performed on each sub-pixel of the input image quickly.

Exemplarily, the obtaining unit is further configured to:

Read the functional relationship corresponding to the current sub-pixel from a non-volatile memory to the volatile memory, before obtaining the functional relationship corresponding to the current sub-pixel from the volatile memory.

Since a data is only retained in the volatile memory for a short time, by storing the functional relationship between the compensated grayscale value and the input grayscale value corresponding to each sub-pixel of the display device which is set for the sub-pixel in advance in the non-volatile memory, life of the stored data can be ensured; and at the same time, when the display device works normally, the functional relationship is read from the non-volatile memory to the volatile memory, and the functional relationship is obtained from the volatile memory in real time, so as to ensure efficiency of real-time compensation.

Exemplarily, the functional relationship between the compensated grayscale value and the input grayscale value corresponding to any one of the sub-pixels complies with a formula below:

$$G_{ij,x}'=C_{ij,n}G_x^n+C_{ij,n-1}G_x^{n-1}+\ldots+C_{ij,1}G_x+C_{ij,0};$$

Where, $G_{ij,x}'$ is a compensated grayscale value corresponding to a sub-pixel in i-th row and j-th column, $G_x$ is an input grayscale value corresponding to the sub-pixel, $C_{ij,n}$ is a coefficient of an n-th expansion item of $G_x$, n is natural number, and i, j are positive integers.

An embodiment of the present invention further provides a display device, the display device comprising the above-described luminance compensation device. The display device may be: a liquid crystal panel, E-paper, an OLED panel, a mobile phone, a tablet computer, a television, a display, a notebook computer, a digital photo frame, a navigator, or any other product or component having a display function.

Hereinafter, it is illustrated with the presetting unit being the data processor independent of the display device as an example, and at the same time, with the luminance compensation device being the control module of the display device as an example.

Figure 8:
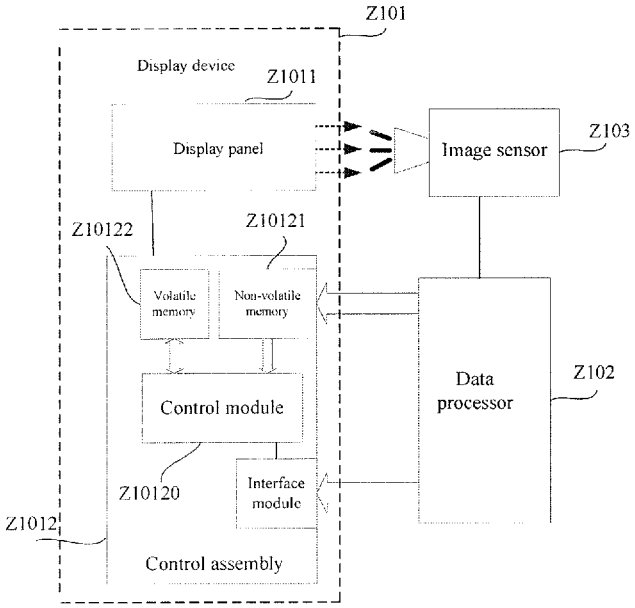
FIG. 8 is a structural block diagram of a display device comprising the luminance compensation device provided by an embodiment of the present invention.

As shown in FIG. 8, when luminance compensation is performed on a display device Z101, a test luminance value of a pixel under a test pattern is collected by using an image sensor Z103.

Therein, the display device Z101 comprises a display panel Z1011 and a control assembly Z012 for controlling display of the display panel.

Exemplarily, the control assembly Z1012 includes: a control module Z10120, a non-volatile memory Z10121, a volatile memory Z10122 and an interface module.

Exemplarily, the control module Z10120 includes:

An obtaining unit, configured to: obtain an input grayscale value of a current sub-pixel and a functional relationship corresponding to the current sub-pixel, for each sub-pixel corresponding to the display device in an input image; the functional relationship being a corresponding relationship between a compensated grayscale value and the input grayscale value corresponding to the sub-pixel and determined according to a test luminance value and a target luminance value of the sub-pixel under a plurality of test patterns of different grayscale values in advance, for each sub-pixel of the display device.

A compensating unit, configured to obtain the compensated grayscale value corresponding to the sub-pixel by using the input grayscale value of the sub-pixel and the corresponding functional relationship, and perform luminance compensation on the sub-pixel according to the compensated grayscale value, for each sub-pixel corresponding to the display device in the input image;

The non-volatile memory Z10121 and the volatile memory Z10122 are both used for storing the functional relationship between the compensated grayscale value and the input grayscale value corresponding to each sub-pixel of the display device which is preset for the sub-pixel. Therein, the non-volatile memory Z10121 is used for storing the functional relationship between the compensated grayscale value and the input grayscale value corresponding to each sub-pixel of the display device which is preset for the sub-pixel and sent by a data processor Z102, and the volatile memory Z10122 is used for storing the functional relationship between the compensated grayscale value and the input grayscale value corresponding to each sub-pixel of the display device which is preset for the sub-pixel and read by the control module from the non-volatile memory Z10121; and The interface module, configured to receiving the input test pattern in a testing stage, and for receiving the input image when the display normally displays. Technologies known to the inventor are used for the module, which will not be repeated here.

The display panel Z1011 may either be an AMOLED, or be a liquid crystal display panel, which will not be limited here.

Exemplarily, the data processor Z102 is configured to: obtain the test luminance value under different test patterns collected by using the image sensor, after selecting a part of the grayscale values from among all grayscale values of the display device as the test grayscale values and determining the test patterns according to the selected test grayscale values.

And, for each sub-pixel, determine a functional relationship between the test luminance value and the test grayscale value of the sub-pixel, according to a plurality of test grayscale values and test luminance values under the plurality of test grayscale values;

determine a functional relationship between the target luminance value and the test grayscale value of the sub-pixel, according to the plurality of test grayscale values and target luminance values under the plurality of test grayscale values;

determine a grayscale compensation amount corresponding to each of the test grayscale values of the sub-pixel, according to the functional relationship between the test luminance value and the input grayscale value and the functional relationship between the target luminance value and the test grayscale value;

determine a functional relationship between the compensated grayscale value and the test grayscale value corresponding to the sub-pixel, according to the grayscale compensation amount corresponding to each of the test grayscale values of the sub-pixel, that is, the functional relationship between the compensated grayscale value and the input grayscale value corresponding to the sub-pixel.

In summary, in the luminance compensation method and the luminance compensation device of the display device, and the display device provided by embodiments of the present invention, the functional relationship between the compensated grayscale value and the input grayscale value corresponding to each sub-pixel is determined in advance, according to the test luminance value and the target luminance value of the sub-pixel under the plurality of test patterns; when the display device normally displays, the functional relationship corresponding to each sub-pixel is obtained, and luminance compensation is performed on the sub-pixel by using the functional relationship corresponding to the sub-pixel, for each sub-pixel corresponding to the display device in the input image, so it is not necessary to perform measurement for each grayscale value of the display device, thus improving the luminance information extraction efficiency for the display device, in the process of improving the luminance uniformity of the display device. Further, by storing the functional relationship between the compensated grayscale value and the input grayscale value corresponding to the sub-pixel which is preset for each sub-pixel of the display device in the non-volatile memory, life of the stored data can be ensured; and at the same time, when the display device works normally, the functional relationship is read from the non-volatile memory to the volatile memory, and the functional relationship is obtained from the volatile memory in real time, so as to ensure the efficiency of the real-time compensation.

The solution of an embodiment of the present invention is described herein with reference to flowcharts and/or block diagrams of a method, an apparatus (system), and a computer program product according to the embodiments of the invention. It should be understood that each flow and/or block in the flowchart and/or block diagram, and a combination of flow and/or block in the flowchart and/or block diagram may be implemented by computer program instructions. These computer program instructions may be provided to a general-purpose computer, a special-purpose computer, an embedded processor or a processor of other programmable data processing apparatus to form a machine, such that devices for implementing functions specified by one or more flows in a flowchart and/or one or more blocks in a block diagram may be generated by executing the instructions with the processor of the computer or other programmable data processing apparatus.

These computer program instructions may also be stored in a computer-readable memory that can direct a computer or other programmable data processing apparatus to function in a particular manner, such that the instructions stored in the computer-readable memory produce a manufactured article including an instruction device, the instruction device implementing the functions specified by one or more flows in a flowchart and/or one or more blocks in a block diagram.

These computer program instructions may also be loaded onto a computer or other programmable data processing apparatus, such that a series of process steps may be executed on the computer or other programmable data processing apparatus to produce a process implemented by the computer, and thereby, the instructions executed on the computer or other programmable data processing apparatus provide steps of the functions specified by one or more flows in a flowchart and/or one or more blocks in a block diagram.

The embodiment of the invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

The present application claims priority of Chinese Patent Application No. 201410240526.7 filed on May 30, 2014, the disclosure of which is incorporated herein by reference in its entirety as part of the present application.

What is claimed is:

1. A luminance compensation method of a display device, comprising:

obtaining an input grayscale value of one of a plurality of sub-pixels corresponding to the display device of an input image, and obtaining a functional relationship between a compensated grayscale value and the input grayscale value corresponding to the sub-pixel;

obtaining the compensated grayscale value corresponding to the sub-pixel by using the functional relationship, and performing luminance compensation on the sub-pixel according to the compensated grayscale value; and executing the above operations repeatedly for each of the plurality of sub-pixels of the input image;

wherein the functional relationship is determined for each of the sub-pixels of the display device, according to a test luminance value and a target luminance value of the sub-pixel under a plurality of test a terns of different test grayscale values.

2. The luminance compensation method according to claim 1, wherein the functional relationship is determined by steps of:

determining a functional relationship between the test luminance value and the test grayscale value of each sub-pixel of the display device, according to a plurality of test grayscale values and test luminance values under the plurality of test grayscale values;

determining a functional relationship between the target luminance value and the test grayscale value of the sub-pixel, according to a plurality of test grayscale values and target luminance values under the plurality of test grayscale values;

determining a grayscale compensation amount corresponding to each of the test grayscale values of the sub-pixel, according to the functional relationship between the test luminance value and the test grayscale value and the functional relationship between the target luminance value and the test grayscale value;

determining a functional relationship between the compensated grayscale value and the test grayscale value corresponding to the sub-pixel, according to the grayscale compensation amount corresponding to each of the test grayscale values of the sub-pixel, the functional relationship between the compensated grayscale value and the test grayscale value corresponding to the sub-pixel being just the functional relationship between the compensated grayscale value and the input grayscale value corresponding to the sub-pixel.

3. The luminance compensation method according to claim 2, before the functional relationship is determined, further comprising:

selecting a part of grayscale values from among all grayscale values of the display device as the plurality of test grayscale values;

determining different test patterns according to the plurality of test grayscale values selected;

collecting the test luminance values under the different test patterns by using an image sensor.

4. The luminance compensation method according to claim 2, wherein, the functional relationship between the test luminance value and the test grayscale value of each of the sub-pixels of the display device, complies with a formula below:

$$L_{ij,x}=A_{ij,n}G_x^{\,n}+A_{ij,n-1}G_x^{\,n-1}+\ldots+A_{ij,1}G_x+A_{ij,0},$$

where, $L_{ij,x}$ is a test luminance value corresponding to an input grayscale value $G_x$ of a sub-pixel in i-th row and j-th column, $G_x$ is the input grayscale value corresponding to the sub-pixel, $A_{ij,n}$ is a coefficient of an n-th expansion item of $G_x$, n is a natural number, and i,j are positive integers.

5. The luminance compensation method according to claim 2, wherein, the target luminance value of each of the sub-pixels under each of the test grayscale values is preset.

6. The luminance compensation method according to claim 2, wherein, the target luminance value of each of the sub-pixels under each of the test grayscale values is obtained by averaging the test luminance values of the plurality of sub-pixels under the test grayscale value.

7. The luminance compensation method according to claim 5, wherein, the functional relationship between the target luminance value and the test grayscale value of the sub-pixel complies with a formula below:

$$L_{t,x}=B_{t,n}G_x^n+B_{t,n-1}G_x^{n-1}+\ldots+B_{t,1}G_x+B_{t,0},$$

where, $L_{t,x}$ is a target luminance value corresponding to an input grayscale value $G_x$, $B_{t,n}$ is a coefficient of an n-th expansion item of $G_x$, n is a natural number, and i,j are positive integers.

8. The luminance compensation method according to claim 1, wherein, the obtaining a functional relationship between a compensated grayscale value and the input grayscale value corresponding to the sub-pixel includes:

obtaining the functional relationship from a volatile memory.

9. The luminance compensation method according to claim 8, wherein, the obtaining a functional relationship between a compensated grayscale value and the input grayscale value corresponding to the sub-pixel further includes:

reading the functional relationship corresponding to the sub-pixel from a non-volatile memory to the volatile memory, before obtaining the functional relationship from the volatile memory.

10. The luminance compensation method according to claim 1, wherein, the functional relationship between the compensated grayscale value and the input grayscale value corresponding to each of the plurality of sub-pixels, complies with a formula below:

$$G_{ij,x}'=C_{ij,n}G_x^n+C_{ij,n-1}G_x^{n-1}+\ldots+C_{ij,1}G_x+C_{ij,0},$$

where, $G_{ij,x}'$ is a compensated grayscale value corresponding to a sub-pixel in i-th row and j-th column, $G_x$ is an input grayscale value corresponding to the sub-pixel, $C_{ij,n}$ is a coefficient of an n-th expansion item of $G_x$, n is a natural number, and i,j are positive integers.

11. A luminance compensation device of a display device, comprising:

an obtaining unit, configured to obtain an input grayscale value of a current sub-pixel, and obtain a functional relationship between a compensated grayscale value and the input grayscale value corresponding to the sub-pixel, for each of sub-pixels corresponding to the display device in an input image;

a compensating unit, configured to obtain the compensated grayscale value corresponding to the sub-pixel by using the input grayscale value of the sub-pixel and the functional relationship, and perform luminance compensation on the sub-pixel according to the compensated grayscale value, for each of the sub-pixels corresponding to the display device in the input image; and a presetting unit, configured to:

determine a functional relationship between a test luminance value and a test grayscale value of each of the sub-pixels, according to a plurality of test grayscale values and a plurality of test luminance values under the plurality of test grayscale values for each of the sub-pixels of the display device;

wherein the presetting unit is further configured to:

select a part of grayscale values from among all of the grayscale values of the display device as the plurality of test scale values determine a plurality of test patterns according to the plurality of test a scale values selected and obtain the plurality of test luminance values by collecting the test luminance value under each of the plurality of test patterns by using an image sensor.

12. The luminance compensation device according to claim 11, wherein the presetting unit is further configured to:

determine a functional relationship between a target luminance value and the test grayscale value of the sub-pixel, according to the plurality of test grayscale values and target luminance values under the plurality of test grayscale values;

determine a grayscale compensation amount corresponding to each of the test grayscale values of each of the sub-pixels, according to the functional relationship between the test luminance value and the test grayscale value and the functional relationship between the target luminance value and the test grayscale value;

determine a functional relationship between the compensated grayscale value and the test grayscale value corresponding to the sub-pixel, according to the grayscale compensation amount corresponding to each of the test grayscale values of the sub-pixel, the functional relationship between the compensated grayscale value and the test grayscale value corresponding to the sub-pixel being just the functional relationship between the compensated grayscale value and the input grayscale value corresponding to the sub-pixel.

13. The luminance compensation device according to claim 11, wherein, the functional relationship between the compensated grayscale value and the input grayscale value corresponding to each of the sub-pixels complies with a formula below:

$$G_{ij,x}'=C_{ij,n}\,G_x^n+C_{ij,n-1}G_x^{n-1}+\ldots+C_{ij,1}G_x+C_{ij,0},$$

where, $G_{ij,x}'$ is a compensated grayscale value corresponding to a sub-pixel in i-th row and j-th column, $G_x$ is an input grayscale value corresponding to the sub-pixel, $C_{ij,n}$ is a coefficient of an n-th expansion item of $G_x$, n is a natural number, and i, j are positive integers.

14. A display device, comprising: the luminance compensation device according to claim 11.

15. The display device according to claim 14, wherein the luminance compensation device is a control module of the display device.

16. The display device according to claim 14, wherein the presetting unit of the luminance compensation device is a processor disposed outside the display device.

17. The luminance compensation device according to claim 11, wherein the obtaining unit is configured to: obtain the functional relationship from a volatile memory.

18. The luminance compensation device according to claim 17, wherein the obtaining unit is further configured to:

read the functional relationship corresponding to the current sub-pixel from a non-volatile memory to the volatile memory, before obtaining the functional relationship from the volatile memory.

* * * * *